US010767661B2

(12) United States Patent
Polston

(10) Patent No.: US 10,767,661 B2
(45) **Date of Patent: *Sep. 8, 2020**

(54) SUBMERSIBLE PUMP WATER JETTER

(71) Applicant: U.S. Submergent Technologies, LLC, Sarasota, FL (US)

(72) Inventor: Henry Polston, Livingston, TX (US)

(73) Assignee: U.S. Submergent Technologies, LLC, Sarasota, FL (US)

( * ) Notice: Subject to any disclaimer, the term of this patent is extended or adjusted under 35 U.S.C. 154(b) by 244 days.

This patent is subject to a terminal disclaimer.

(21) Appl. No.: 15/635,534

(22) Filed: Jun. 28, 2017

(65) Prior Publication Data

US 2017/0343017 A1 Nov. 30, 2017

Related U.S. Application Data

(63) Continuation of application No. 12/478,547, filed on Jun. 4, 2009, now Pat. No. 9,695,839.

(51) Int. Cl.

| | |
|---|---|
| ***F04F 1/18*** | (2006.01) |
| ***E03F 9/00*** | (2006.01) |
| ***F04D 7/04*** | (2006.01) |
| ***F04D 13/04*** | (2006.01) |
| ***B08B 9/051*** | (2006.01) |
| ***B08B 9/02*** | (2006.01) |
| ***B08B 9/032*** | (2006.01) |
| ***E02B 1/00*** | (2006.01) |

(52) U.S. Cl.

CPC ..... *F04F 1/18* (2013.01); *B08B 9/051* (2013.01); *E02B 1/003* (2013.01); *E03F 9/00* (2013.01); *F04D 7/04* (2013.01); *F04D 13/046* (2013.01); *B08B 9/02* (2013.01); *B08B 9/0328* (2013.01)

(58) Field of Classification Search

CPC ... B08B 9/0321; B08B 9/0433; F04D 13/046; F04D 7/04

See application file for complete search history.

(56) References Cited

U.S. PATENT DOCUMENTS

| | | | | |
|---|---|---|---|---|
| 3,334,816 | A | 8/1967 | Mizuno | |
| 4,308,138 | A | 12/1981 | Woltman | |
| 4,793,386 | A * | 12/1988 | Sloan | E03F 7/10 137/351 |
| 5,022,586 | A * | 6/1991 | Putnam | B05B 13/0436 239/71 |
| 5,336,333 | A | 8/1994 | Sheppard et al. | |
| 5,415,352 | A | 5/1995 | May | |
| 6,178,570 | B1 | 1/2001 | Denst et al. | |
| 6,533,033 | B2 * | 3/2003 | Skillman | E21B 43/121 166/105.1 |
| 6,736,572 | B2 | 5/2004 | Geraghty | |
| 2006/0179603 | A1 * | 8/2006 | Polston | B08B 9/043 15/340.1 |
| 2010/0119381 | A1 | 5/2010 | Scarsdale | |

FOREIGN PATENT DOCUMENTS

| | | | |
|---|---|---|---|
| GB | 544459 | A | 4/1946 |
| JP | 2004066012 | A | 3/2004 |

* cited by examiner

*Primary Examiner* — Mikhail Kornakov
*Assistant Examiner* — Natasha N Campbell
(74) *Attorney, Agent, or Firm* — McDonald Hopkins LLC

(57) ABSTRACT

An apparatus and method for cleaning containers using water within the container and a submersible pump exhibiting a nozzle. Air may be injected into the pumped water to increase its pressure as it exists the nozzle.

13 Claims, 4 Drawing Sheets

SUBMERSIBLE PUMP WATER JETTER

CROSS-REFERENCE TO RELATED APPLICATIONS

This application is a continuation of U.S. patent application Ser. No. 12/478,547, filed on Jun. 4, 2009, entitled "Submersible Pump Water Jetter," now U.S. Pat. No. 9,695,839 which is hereby incorporated by reference.

FIELD OF THE INVENTION

The invention is in the field of jetter cleaning of containers.

BACKGROUND OF THE INVENTION

Water jetters are used to clean containers, such as sewer pipes, tanks, and ponds. Powerful triplex pumps are used in such applications to create jets of cleaning water, but triplex pumps are sensitive to debris intake and must normally be located outside of the container. For example, use of triplex pumps in sewer cleaning requires use of expensive clean water, such as potable hydrant water. Thus, present sewer cleaning often wastes much potable water.

The instant invention solves a long-existing need for a water jetter for use within containers, having submersible capability, using debris-laden waste water to jet, and generating pressure equal to or greater than that of triplex pumps. Its use of waste water instead of potable water saves money, preserves an important natural resource, and is friendly to the environment.

BRIEF SUMMARY OF THE INVENTION

The invention employs a submersible pump to jet water through a nozzle. Venturi air or pressurized air may be used to enhance the pressure of the jetted water.

DETAILED DESCRIPTION OF THE INVENTION

Figure 1:
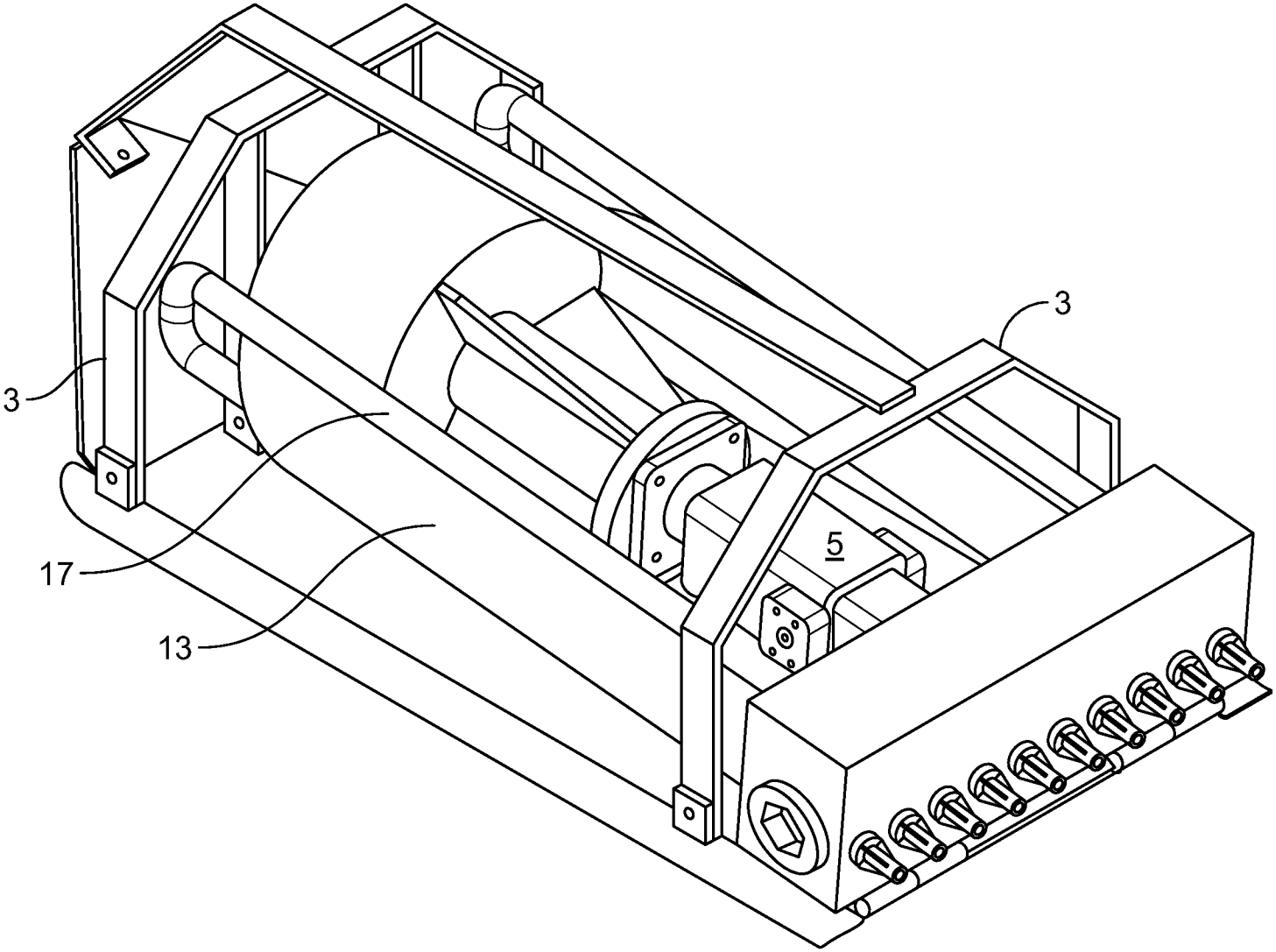
FIG. 1 is a perspective view of an embodiment of the invention.
Figure 2:
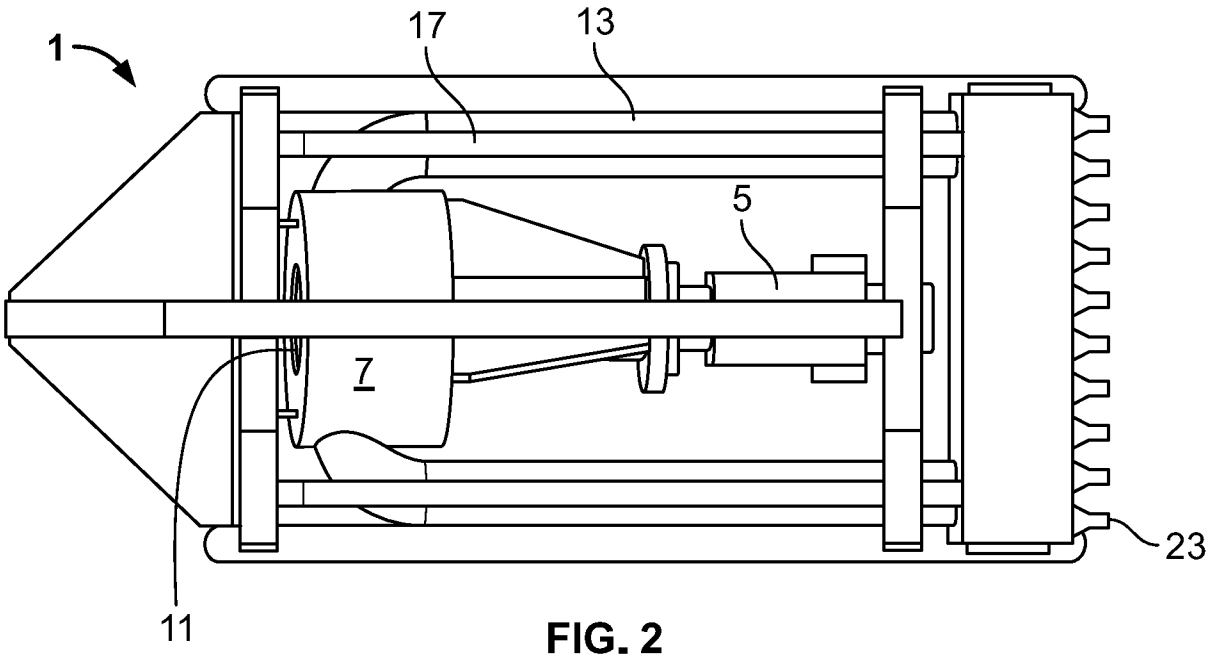
FIG. 2 is a top view of an embodiment of the invention.
Figure 3:
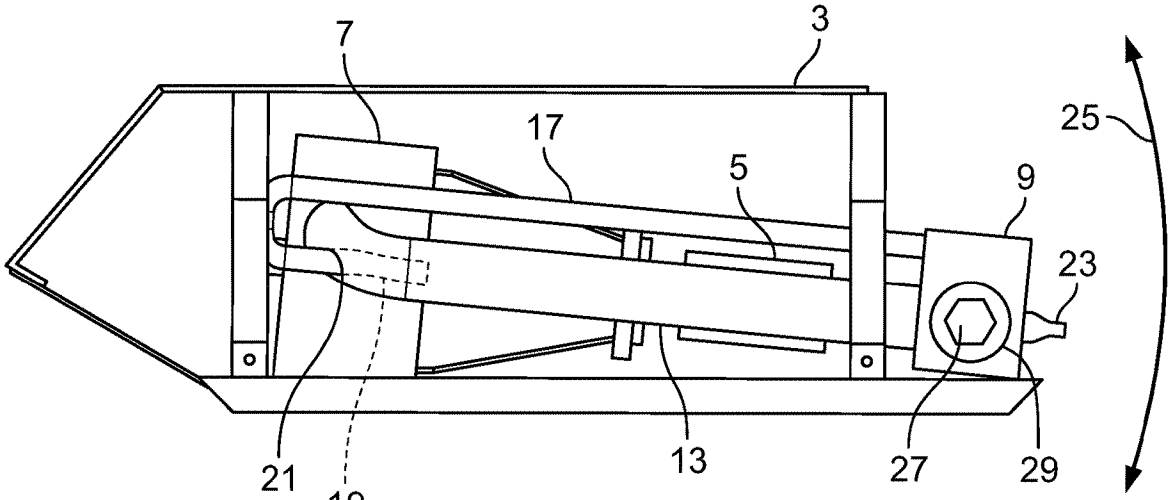
FIG. 3 is a side view of an embodiment of the invention.
Figure 4:
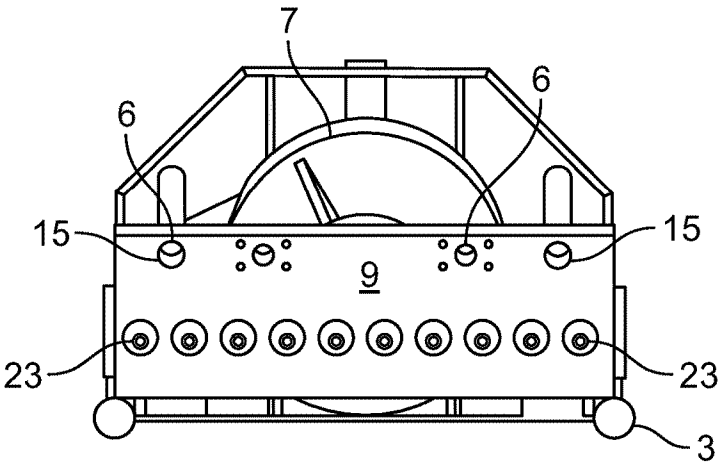
FIG. 4 is a back view of an embodiment of the invention.
Figure 5:
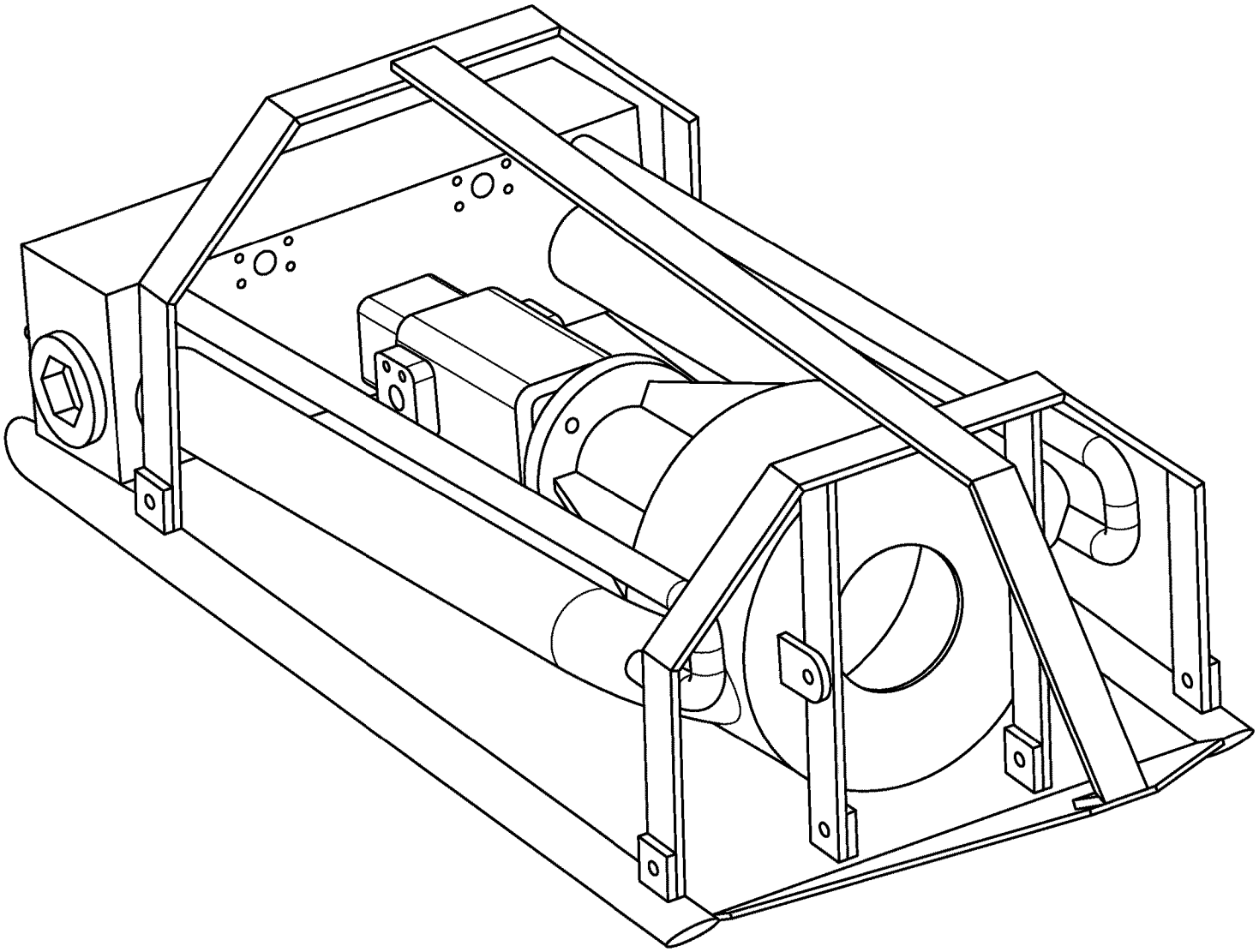
FIG. 5 is second perspective view of an embodiment of the invention.

Referring to the Figures, a jetter assembly 1 comprises a removable skid cage 3, a hydraulic motor 5, a submersible centrifugal pump 7, and a nozzle assembly 9. The hydraulic motor 5 is driven by hydraulic fluid, received through hydraulic fluid intake 6, from a hydraulic pump (not shown). The hydraulic motor, in turn, rotates an impeller (not shown) within the submersible centrifugal pump 7. When submersed in water, the rotating propeller of the centrifugal pump 7 draws water (not shown), into water intake 11 and into the pump 7, from where it is pumped, at a pressure such as 300 psi and at a volume such as 2000 gpm, through water conduits 13 into nozzle assembly 9 and out nozzles 23.

Air at ambient pressure may be drawn into water conduits 13 via air intakes 15 and air conduits 17. The air enters the water conduits 13 at injection points 21. Injection tubes 19 within water conduits 13 are a continuation of air conduits 17. At ambient air pressure, the air is drawn into the conduits 13 by the Venturi effect, as pumped water flows through the water conduits 13.

Air also may be pressurized to a pressure greater than the water pressure created by the pump 7, such as 2000 psi. The pressurized air may be injected into air intake 15 by a pressurized air supply (not shown) through air conduits 17 and injection tubes 19. The pressurized air is released into water conduits 13 through air tubes 19 that enter water conduits 13 at injection points 21.

The injection of air into water conduits 13 substantially increases the pressure of the water as it flows past the air tubes 19. Ambient pressure air is suitable, but higher air pressure increases still further the pressure of the water. The pressure-enhanced water is further driven into nozzle assembly 9, from where the pressure-enhanced water, mixed with the air, is ejected through nozzles 23.

The vertical angle of attack of the nozzle assembly 9 may be adjusted by lifting or lowering the nozzle assembly 9 by generally rotating the assembly within the skid cage 3 about an axis proximal the water intake 11. A range of adjustment is generally indicated by arrows 25.

To use the jetter assembly 1 in the cleaning of a sewer pipe containing flowing waste water, the assembly 1 is connected by hose to a surface supply of pressurized hydraulic fluid and lowered into a manhole. A second hose with ambient or pressurized air may be added. The assembly 1 is oriented with the nozzles downstream the flow of water in the sewer pipe. The jetter assembly 1 is then activated by the hydraulic fluid, driving the centrifuge pump 7. Sewer water entering the water intake 11 is ejected from nozzles 23, driving the jetter assembly 1 a suitable distance upstream from the force of the ejected water. Venturi or pressurized air may be injected to increase the ejected water pressure. Upon reaching the suitable distance, the activated jetter assembly is slowly retracted through the pipe toward the manhole by the pressurized air hose, pressurized hydraulic fluid hose, or other tether between the jetter assembly 1 and the surface above the manhole. As the jetter assembly 1 is retracted, water ejected by nozzles 23 lifts and pushes solids in the sewer pipe downstream and toward the manhole, creating a slurry that can be removed by a submersible pump located in the pipe at approximately the manhole, such as reflected in U.S. Pat. No. 5,336,333.

In sewer pipe and other applications in which the water drawn into the water intake 11 may contain significant, large solids, a screen (not shown) may be placed over water intake 11 to minimize solids intake. Also, solids accumulating in nozzle assembly 9 may be removed by removing the cap 27 of clean-out port 29 and cleaning within the nozzle assembly 9.

"Containers" means any container that may be accessed, including without limitation pipes, tanks, and ponds. With the benefit of this disclosure, one of ordinary skill will understand that the air injection may be configured in a variety of ways, including structure and location variations, suitable for enhancing the pressure of water pressurized by a submersible pump. "Submersible pump" means any pump that operates submerged in water, including without limitation impeller pumps and disk pumps. "Nozzle" means any passageway configured to clean the inside of a container with jetted water.

With the benefit of this disclosure, one of ordinary skill will appreciate that many embodiments of the invention may be employed within the scope of the claims for a variety of applications.

I claim:

1. A jetter comprising:

a submersible, portable pump comprising a liquid intake and a liquid exhaust;

a submersible hydraulic motor comprising a hydraulic fluid intake, the submersible hydraulic motor operatively coupled with the submersible pump controlling a rate at which liquid flows from the liquid intake to the liquid exhaust, wherein the liquid exits the liquid exhaust at a first pressure;

a nozzle in communication with the liquid exhaust, wherein the nozzle expels water at a second pressure to a container to remove debris from the container, wherein the second pressure is greater than the first pressure; and a passageway for injection of air into the liquid exhaust.

2. The jetter of claim 1, wherein the submersible pump, hydraulic motor, hydraulic fluid intake and nozzle are selectively positionable within the container.

3. The jetter of claim 1, wherein the submersible pump pumps water at a volume of approximately 2000 gallons per minute.

4. A fetter comprising:

a nozzle positionable in a container;

a pump comprising an exhaust, the pump positionable in the container, wherein the pump expels water at a first pressure;

a liquid conduit comprising proximal and distal ends in communication with the exhaust, the distal end in communication with the nozzle;

wherein the nozzle is rotatably adjustable and the nozzle expels the water at a second pressure to the container to remove debris from the container; and a gas intake in communication with the liquid conduit, the gas intake pressurizing liquid in the liquid conduit to a pressure greater than a pressure of the liquid in the proximal end of the liquid conduit.

5. The jetter of claim 4 further comprising a skid cage generally enclosing the pump.

6. The jetter of claim 5, wherein the nozzle is pivotable relative to the skid cage.

7. The jetter of claim 6 further comprising a hydraulic motor operatively engaged with the pump.

8. The jetter of claim 7 further comprising a screen operatively engaged with the pump to generally prevent solids from entering the pump.

9. The jetter of claim 8 further comprising a clean out port positioned in the nozzle.

10. The jetter of claim 9 further comprising a removable cap positioned generally over the clean out port.

11. A jetter for cleaning water-containing containers comprising:

a pump hydraulically driven, the pump comprising an intake, wherein the pump pressurizes water to a first pressure;

an exhaust conduit exiting the water pump;

at least one nozzle in communication with the water exhaust conduit, the nozzle releasing liquid at a pressure greater than the first pressure into a container, whereby the pressure removes debris from the container; and a gas conduit in communication with the exhaust conduit, the gas conduit pressurizing liquid within the exhaust conduit to a second pressure, wherein the second pressure is greater than the first pressure.

12. The jetter of claim 11 further comprising a skid cage engaged with the at least one nozzle wherein the at least one nozzle is selectively rotatable relative the skid cage.

13. A fetter comprising:

a submersible, portable pump comprising a liquid intake and a liquid exhaust;

a submersible hydraulic motor comprising a hydraulic fluid intake, the submersible hydraulic motor operatively coupled with the submersible pump controlling a rate at which liquid flows from the liquid intake to the liquid exhaust, wherein the liquid exits the liquid exhaust at a first pressure;

a nozzle in communication with the liquid exhaust, wherein the nozzle expels water at a second pressure to a container to remove debris from the container, wherein the second pressure is greater than the first pressure;

a liquid conduit having proximal and distal ends in communication with the liquid exhaust of the submersible pump, the distal end in communication with the nozzle; and a gas intake in communication with the liquid conduit, the gas intake pressurizing liquid in the conduit to a pressure greater than a pressure of the liquid in the proximal end of the liquid conduit.

* * * * *